US005598849A

United States Patent [19]

Browne

[11] Patent Number: 5,598,849

[45] Date of Patent: Feb. 4, 1997

[54] INTERACTIVE EXERCISE MONITORING SYSTEM AND METHOD

[75] Inventor: Neville J. Browne, Woollahra, Australia

[73] Assignee: Hayle Brainpower P/L, Double Bay, Australia

[21] Appl. No.: 374,632

[22] PCT Filed: Jul. 21, 1993

[86] PCT No.: PCT/AU93/00367

§ 371 Date: Jan. 20, 1995

§ 102(e) Date: Jan. 20, 1995

[87] PCT Pub. No.: WO94/02904

PCT Pub. Date: Feb. 3, 1994

[30] Foreign Application Priority Data

Jul. 21, 1992 [AU] Australia ..... PL 3659
Dec. 31, 1992 [AU] Australia ..... PL 6611

[51] Int. Cl.[6] ..... A61B 5/04

[52] U.S. Cl. ..... 128/707

[58] Field of Search ..... 128/689, 690, 128/706, 707, 903, 904; 364/413.04, 413.05, 413.06

[56] References Cited

U.S. PATENT DOCUMENTS 4,686,624 8/1987 Blum et al. .
4,860,763 8/1989 Schminke ..... 128/904
5,410,472 4/1995 Anderson ..... 128/707
5,458,548 10/1995 Crossing et al. ..... 128/707
5,474,090 12/1995 Begun et al. ..... 128/707

FOREIGN PATENT DOCUMENTS 0005949 12/1979 European Pat. Off. .
0057609 8/1982 European Pat. Off. .
0423893 4/1991 European Pat. Off. .
WO87/05727 9/1987 WIPO .
WO89/00061 1/1989 WIPO .

OTHER PUBLICATIONS

Aerobic Exercise: Introduction and Outdoor Options, "Health & Fitness Excellence" by Robert K. Cooper, Ph.D., 1989, 7 pgs.
Copies of brochures from Polar US Inc., 1991, 4 pgs.

*Primary Examiner*—William E. Kamm
*Attorney, Agent, or Firm*—Darby & Darby, P.C.

[57] ABSTRACT

A fitness monitoring system comprises a personal exercise monitoring device which is preprogrammed with data to guide a user in a desirable exercise regime. The monitoring device includes communication means enabling connection to a central computer system for downloading data recorded during an exercise session to the central computer. The central computer has stored information enabling it to compare this information and that sent by the monitoring device to provide performance reports. These enable feedback to the user via a personal trainer.

44 Claims, 5 Drawing Sheets

INTERACTIVE EXERCISE MONITORING SYSTEM AND METHOD

The present invention relates to a system for provision of an exercise regimen for users and, in particular, to a system which facilitates semi-automated monitoring of a user's progress in the exercise regimen.

The present invention also relates to a novel device for monitoring heartbeat.

The present invention further relates to a novel data processing device for facilitating the provision and monitoring of an exercise regimen for a user.

One of the most important factors in maintaining good health is physical exercise. A number of major studies in recent years have demonstrated the health benefits of regular physical exercise, particularly in respect to maintaining a healthy cardiovascular system.

The beneficial effects off physical exercise can be negated, however, if the physical exercise regimen is not carefully designed, or if the physical exercise regimen is not correctly followed. "Over-training" is an all too common syndrome in athletes and others engaging in physical training programs, which can produce severe physical effects such as skeletal and heart muscle wasting, tiredness and degradation of the body's immune system. When "unfit" people commence a program of physical exercise, the dangers of an ill designed program or the person incorrectly carrying out the program can even be greater. When the body is not used to exercise, sudden physical stress can lead to stroke and fatality.

In order to gain the benefits of regular physical exercise, therefore, it has been common for people to attend gymnasiums where they can obtain the benefits of "coaching" from trainers employed by the gymnasium. A problem with this is that, in order to obtain the benefits of monitoring of exercise by the gymnasium staff, it is necessary for the user to attend the gymnasium at frequent intervals. This can be inconvenient, particularly where the gymnasium is not located near the user. Further, one gym instructor will usually have to attend to the needs of many gym users. Each user does not really have the benefit of personal coaching. It is, therefore, still possible for a user to incorrectly exercise, possibly leading to some of the ill-effects discussed above.

An alternative to training in a public or private gymnasium is to hire one's own personal trainer. Obviously, the expense of this is prohibitive for most people.

From a first aspect, the present invention provides a method of monitoring the progress of a user in an exercise regimen, comprising the steps of storing a preset physical parameter target value relating to the user's exercise regimen in a master data processing means, monitoring a user exercise event by measuring the physical parameter value using a user monitoring device, transmitting the measured parameter value relating to the exercise event from the user monitoring device to the master data processor means, and using the master data processor to compare the transmitted parameter value with the stored preset physical parameter value relating to the user's exercise regimen and to report the users performance relative to his preset value.

The exercise regimen may be any physical exercise routine or system determined for the physical exercise of the user. A user exercise event would generally be a single performance of an exercise routine by the user. For example, the exercise regimen may require the user to undertake a "whole of body" exercise, such as swimming or walking, for example, for a predetermined time period. The regimen may require that this exercise event be performed a number of times a week.

The user monitor is preferably arranged, during operation, to monitor and store the physical parameter value relating to the user exercise event. The physical parameter value can then be subsequently downloaded to the master data processor means at the user's convenience.

Preferably, during the performance of an exercise event, the user is required to monitor at least one physical parameter with the assistance of the user monitor. The user is preferably required, during the performance of the exercise event, to control his exercising to maintain the physical parameter as close as possible to preset values of the parameter. The preset values for the physical parameter are preferably initially determined for the user before he commences the particular exercise regimen.

A preferred further step in the method of the present invention is an initial physical assessment of the user, from which preset values for a physical parameter are preferably determined.

In the preferred embodiment of the present invention, physical parameter values stored in the master data processing means and parameter values stored in the user monitor relate to the heart-rate of the user, and are preferably a measure of heart-rate over a period of time during exercise. Heart rate over the exercise period is a convenient way of monitoring the effect of exercise on the user, and the user's progress in the exercise regimen. It is possible that other physical parameters could be used in the present invention to monitor the user's progress, instead of or in addition to monitoring of heart-rate.

Where heart-rate is used to monitor the user's exercise, the physical parameter values stored are preferably stored in the form of a "heart-rate curve", i.e. a curve plotting heart-rate against time during the period of a single exercise event. When the user first commences the exercise regimen, physiological tests are made on him. From the test results, the master data processing means produces a "heart-rate curve" specific to the particular user. The user heart-rate curve is designed to be "ideal" for the user and his particular exercise event, and during subsequent exercise events (which the user may perform anywhere—in his home, for example) the user is asked to keep his heart-rate as close as possible to this heart-rate curve.

From a second aspect, the present invention further provides an exercise monitoring system for monitoring the progress of a user in an exercise regimen, comprising a master data processing means and a user monitor, the data processing means having storage means to store a physical parameter value relating to the user's exercise regimen and data receiving means to receive data transmitted by the user monitor, and the user monitor having exercise monitoring means to monitor a user's exercise event to measure a parameter value relating to the user exercise event and data transmitting means arranged to transmit the parameter value to the master data processing means, the master data processing means further including data comparison means to compare the parameter value transmitted by the user monitor with the stored physical parameter value relating to the user's exercise regimen, whereby to monitor the user's progress in the exercise regimen.

Preferably, many users may be served by a single master data processing means.

The master data processing means may be a computer of appropriate data handling capacity, appropriately programmed to receive data from the user monitor and compare the data with stored data for that user.

The master data processing means is preferably arranged to store values for a particular physical parameter over a period of time corresponding to the length of time of the user's exercise event. During exercise, the user is required to maintain the particular physical parameter as close as possible to these values. The user monitor is preferably arranged to assist the user in monitoring the physical parameter during exercise, and preferably includes storage means for storing preset values corresponding to values stored in the master data processing means for the physical parameter.

The user monitor further preferably includes memory means for storing values of the physical parameter taken during the performance of the exercise event by the user. These values can subsequently be downloaded to the master data processing means for comparison with the present values stored therein.

In the preferred embodiment, the physical parameter used is heart-rate.

The system in accordance with the present invention preferably enables a user's compliance with the predetermined exercise regimen to be monitored for example, the determination of whether the user is performing his exercise regimen at the required frequency may be made.

The master data processor is preferably arranged to allow interaction with personal trainers (PTs), each PT being responsible for a number of users, and includes means allowing interactive voice recordings to be placed.

The master data processing means can preferably be used in implementation of the method of the first aspect of the invention and its preferred aspects.

The master data processing means is preferably arranged to receive data from the user monitor without the need for any human interface. In the preferred embodiment, the data processing means has access to telephone lines or other means by which it may communicate with the user monitor, to enable reception of parameter value results for an exercise event and comparison with the stored parameter values.

The user monitor preferably includes means for monitoring the heart-rate of the user during an exercise event and means for storing values of heart-rate at time intervals during the exercise event.

The user monitor preferably further includes means for downloading the stored data relating to an exercise event to the master data processing means. Preferably, the means for downloading comprises means for interfacing with a standard telephone set to send information down a telephone line to the master data processing means.

The user monitor preferably further includes means for storing heart-rate data to enable generation of a "heart-rate curve", i.e. a curve plotting heart-rate against time during the period of a single exercise event, and means for comparing the heart-rate of the user during the exercise event with the generated heart-rate curve, to determine whether or not the user's heart-rate is within predetermined limits of the heart-rate curve. The "heart-rate curve" is as discussed above in relation to the first aspect of the present invention and reflects variations in the user's heart-rate over the period of time of a user exercise event. It is preferably stored in the master data processing means and the user monitor. It may be stored as a plurality of heart-rate readings for predetermined time intervals during the exercise event, rather than actually being in the form of an analogue curve. The curve may be extrapolated from the stored data.

The user monitor is also preferably provided with indicator means, arranged to indicate whether the user's heart-rate is within predetermined limits of the heart-rate curve.

The user monitor is also preferably arranged to store date and time of an exercise event. This may be associated with the physical parameter data for the particular exercise event, as a form of "tag" to enable the master data processor to place in time the data from the user monitor. The user monitor also preferably stores data enabling identification of the user by the master data processing means.

From a third aspect, the present invention further provides an exercise monitor for facilitating monitoring of the progress of a user in an exercise regime, the exercise monitor being arranged to monitor a user exercise event and to store parameter values relating to the exercise event and including physical parameter measuring means arranged to measure physical parameter data during an exercise event and data transmitting means for transmitting the measured physical parameter data to a central monitoring system.

The user monitor is also preferably provided with a logging mode for recording a physical parameter over an extended period of time, the parameter being stored at regular intervals the period of which may vary over the length of the logging period.

The user monitor may include any or all of the preferred features discussed above in relation to the user monitor included in the second aspect of the invention, in order to facilitate use of the user monitor in such a system for monitoring the progress of a user in an exercise regime. The user monitor of this aspect of the present invention is preferably intended for use in a method according to the first aspect of the present invention.

The present invention advantageously enables careful monitoring of an exercise programme of a user, without the need for the user to make frequent attendance at a particular location, such as a gymnasium.

When the user is provided with a user monitor which has provision for transmission of exercise data to the central computer, it means that the user can exercise anywhere and still have the benefits of his exercise programme being monitored by experts, without any exercise location restrictions and without the expense of a personal trainer.

Features and advantages of the present invention will become apparent from the following description of an embodiment thereof, by way of example only, with reference to the accompanying drawings, in which.

Figure 5:
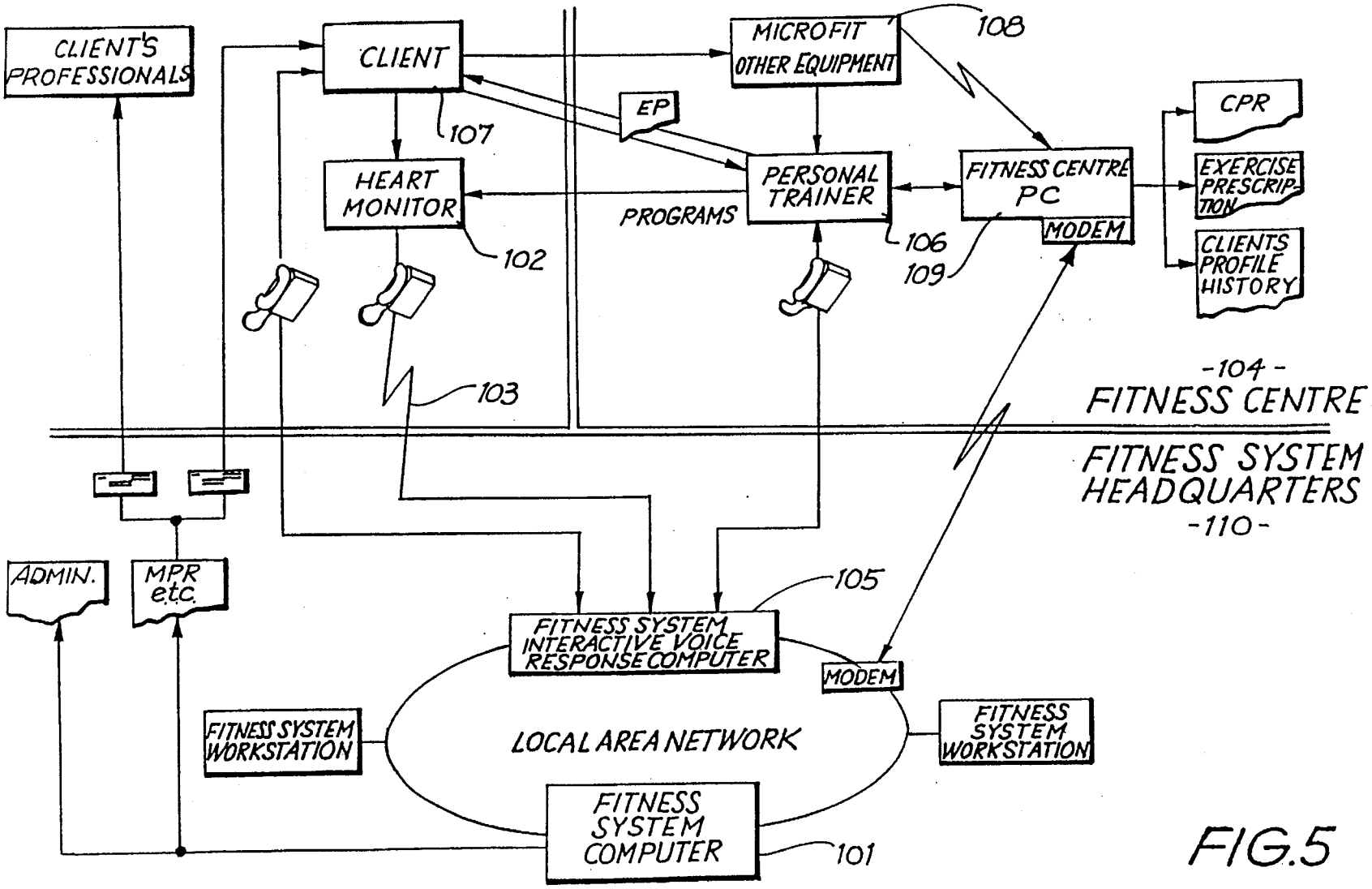
FIG. 5 is an overall block diagram of the preferred embodiment of a system for monitoring training in accordance with the present invention.

Referring to FIG. 5, the system of the preferred embodiment of the present invention includes a master data processor in the form of a computer 101 arranged to store physical parameter data for a plurality of users. Each user is provided with a user monitor 102 which is arranged to monitor at least one physical parameter of the user during exercise and store data relating to the physical parameter. This data can subsequently be transmitted to the master data processor by pulse transmission from the user monitor down a telephone line 103. The master data processor then compares the received data with the stored data for the user in order to enable monitoring of the progress of the user in an exercise regimen which has been preset for him.

The system enables many users to be monitored by a single central computer. There is no restriction on location of where the user should exercise. It may only be infrequently necessary for the user to visit a central location in order to have his exercise programme set in the first place, and altered at infrequent intervals in accordance with his progress in the exercise regimen, and in order to re-examine pre-set physiological parameters for the user.

In more detail, a user intending to enter into an exercise programme with the assistance of this system will usually be required to attend a centre 104 where a series of tests will be conducted in order to establish the user's physiological profile. The elements of this profile will include the following:

| | |
|---|---|
| 1. Weight | kg |
| 2. Systolic blood pressure | mmHg |
| 3. Diastolic blood pressure | mmHg |
| 4. Fat | % |
| 5. Flexibility | unit |
| 6. Biceps strength | kg |
| 7. Resting heart-rate | bpm |
| 8. Aerobic fitness | $mLKg^{-1}min^{-1}$ |
| 9. Overall fitness | % |
| 10. Cholesterol | $mmol\ L^{-1}$ |
| 11. HDL-cholesterol | $mmole\ L^{-1}$ |
| 12. Cholesterol to HDL | ratio |
| 13. Triglycerides | $mmole\ mm^{-1}$ |
| 14. Glucose | mmole/lt |

The elements of the user's physiological profile may be varied from the above list. Additions may be made to the list, elements changed or elements removed. The above list is one preferred list only.

Based on the results of this physiological profile, an exercise programme will be designed for the user. The exercise programme may have a number of aspects and will depend a great deal on how "fit" the user is and what level of exercise is required. For example, if the user is a professional athlete, a fairly rigorous physical activity will probably be required, tailored for the athlete's particular needs for his sport. On the other hand, if the user is a relatively "unfit" person, the amount of physical activity will be less, will be less intense and tailored to increase his fitness gradually, in accordance with his relative "unfitness". The design of particular exercise regimens from such physiological profiles is known to those people who practise the art.

It is considered that the present invention is particularly suited to people who wish to obtain the physiological and psychological benefits which result from regular exercise. The user of this system is likely to be the "average" person who wishes to "keep fit", although the invention is not restricted to use with such persons.

In the preferred embodiment the exercise regimen determined for the user will be designed such that the user will be exercising aerobically.

In this context we are using the term aerobic exercise in its true sense, and in this regard it will be noted that the popular form of exercise known as "aerobics" is in fact almost certainly not aerobic. To avoid confusion the term "metobic" has been coined to denote truly aerobic exercise.

This special physical activity involves using a whole-of-body motion, (e.g. brisk walking), to raise the heart-rate in a very controlled way through five minutes of warm up until it is beating at the desired Metobic Rate. The Metobic Rate is defined as the heart rate resulting from an exercise activity the intensity of which results in significant beneficial metabolic changes providing the exercise is of sufficient duration and frequency. The Metobic Rate is below the Anaerobic Threshold and above the Aerobic Threshold. It is characterised by low lactate concentrations (1–3 mmol/l) and in terms of perceived exertion it is the heart rate caused by the highest level of exercise intensity at which one feels "comfortable". It is also the heart rate present when the body's energy source is predominantly through lipid oxidation with significant glycolytic oxidation not having yet started. In other words, the body is predominantly burning fats rather than carbohydrates.

The master data processor 101 is arranged to automatically determine a suitable exercise regimen for a user on the basis of the physiological parameters for the user input to the master data processor. The master data processor will automatically perform appropriate calculations utilising the physiological data to produce the suitable exercise regimen for the particular user.

Based on the results of the physiological profile, an exercise programme will be designed with the following features:

1. It will require a "whole of body" physical activity of low intensity. Walking or swimming may be recommended.
2. The activity will take from 30 to 45 minutes each day to perform.
3. The user will be required to commit to performing the activity at least five out of every seven days without ever missing more than two days straight.

It will be appreciated that the system can be designed to produce any type of exercise programme. The exercise programme could be very different, for example if the person it is being designed for is very fit.

Figure 1:
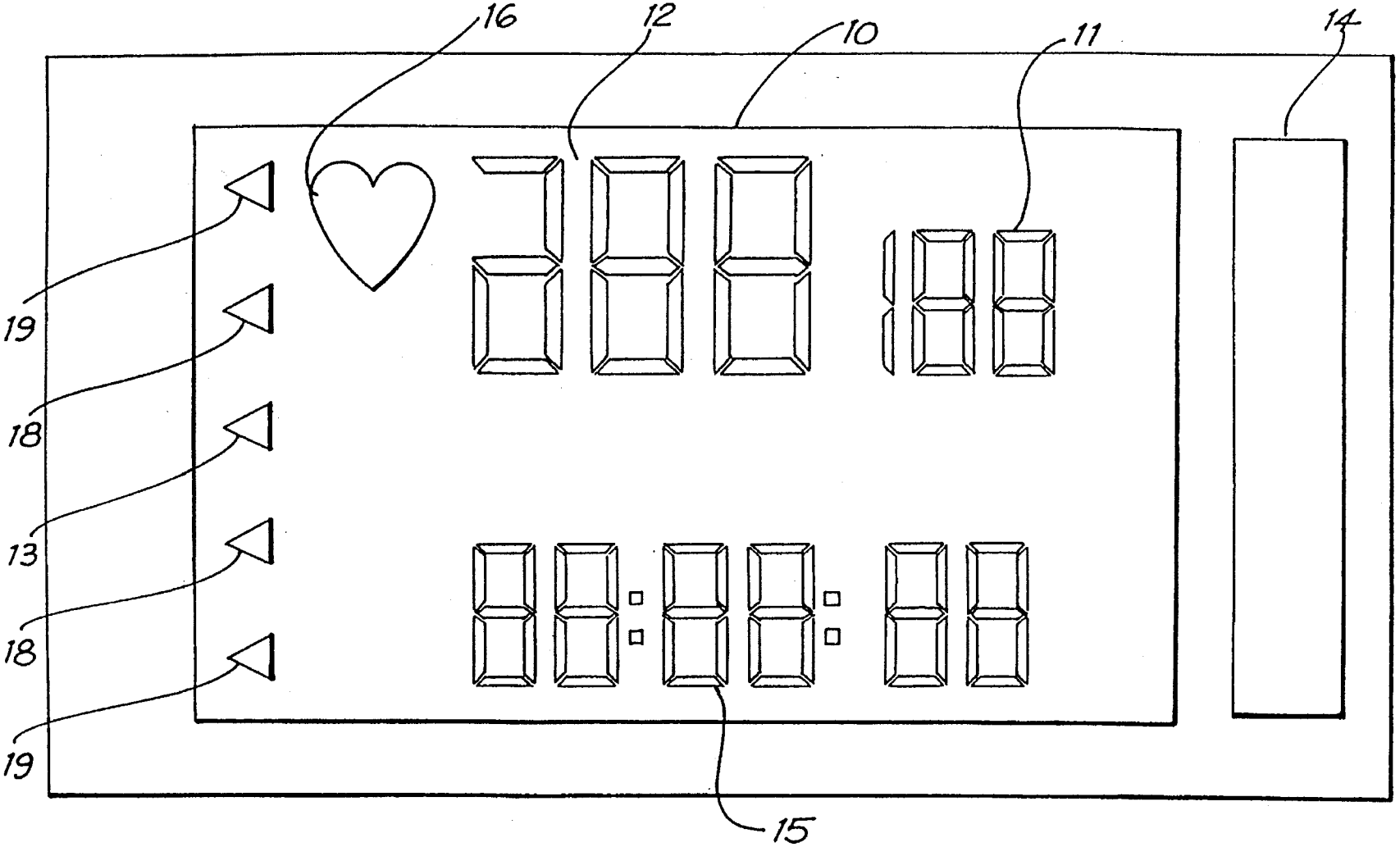
FIG. 1 is a front view of a user monitor in accordance with an embodiment of the present invention.
Figure 2:
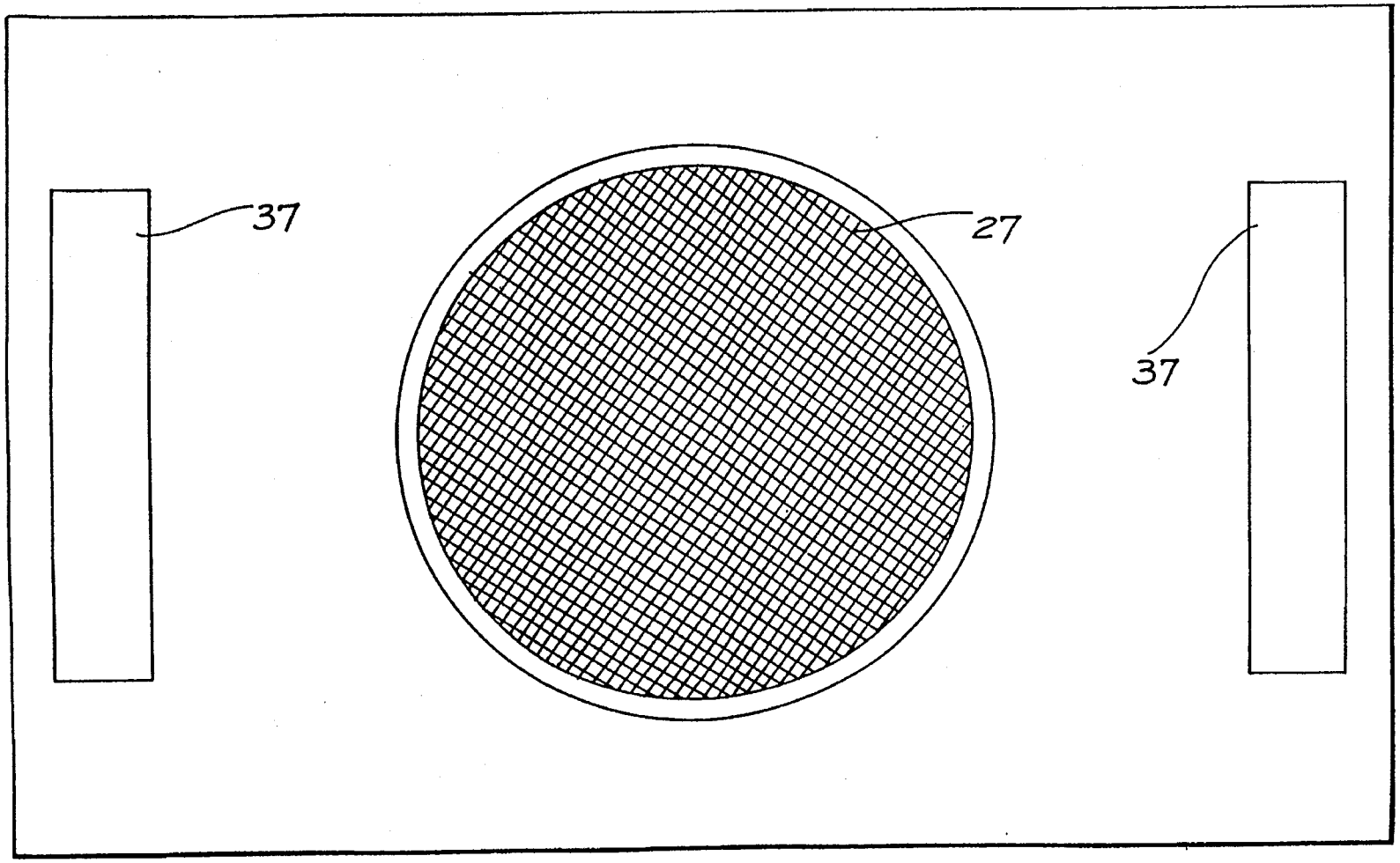
FIG. 2 is a rear view of the user monitor of FIG. 1.
Figure 3:
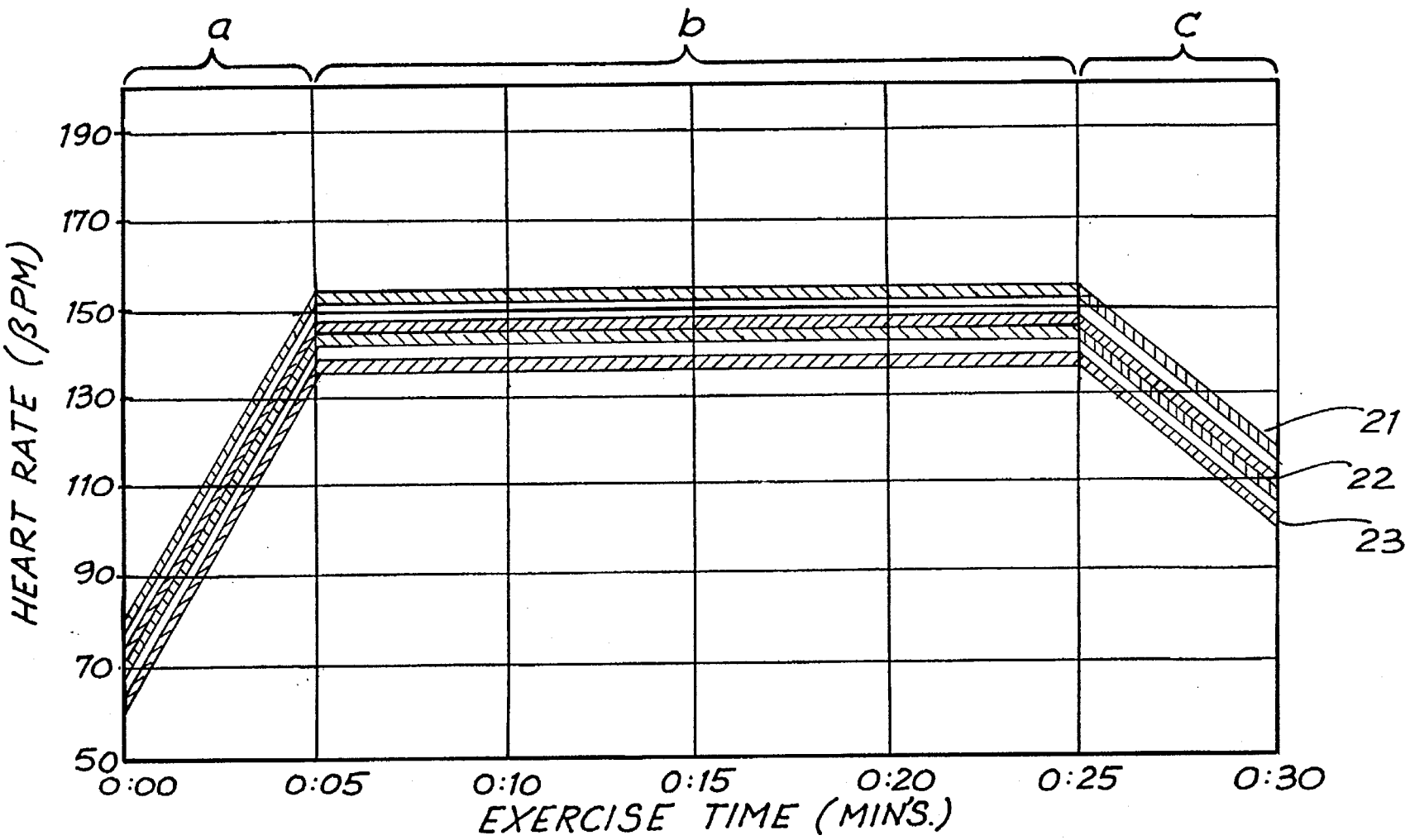
FIG. 3 is an illustration of a heart-rate curve for use in monitoring a user's progress in an exercise regimen, in accordance with an embodiment of the present invention.
Figure 4:
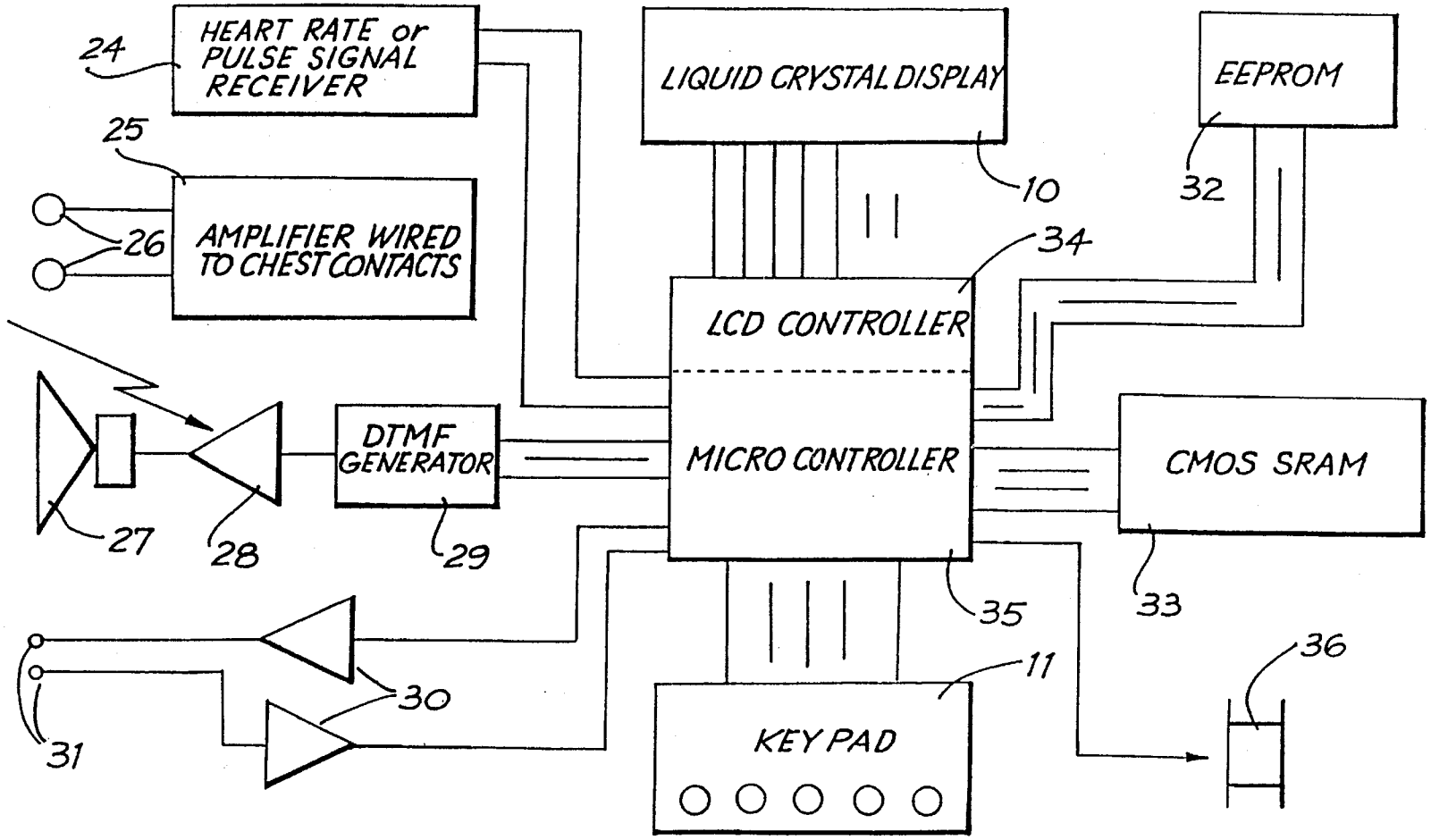
FIG. 4 is a schematic block circuit diagram of the user monitor of FIG. 1.

The master data processor will also produce a "heart-rate curve" (refer to FIG. 3) which is considered to be "ideal" for the exercise programme designed for the user. The heart-rate curve will be automatically produced by the master data processor by the performance of suitable calculations using the physiological parameters and in consideration of the exercise programme which has been designed. As illustrated in FIG. 3, the heart-rate curve will consist of three sections:

Section a. This is the "warm up" zone following the commencement of exercise. In the preferred embodiment, this zone may last for five minutes.

Section b. This is the "exercise time" and will last for as long as required. For the average person it will be preferred that the regimen be designed so that the exercise is always aerobic.

Section c. This is the "cool down" zone and will always last five minutes, in the preferred embodiment.

The heart-rate curve illustrated in FIG. 3 includes three curves. The middle curve 22 is the user's ideal heart-rate curve for a particular exercise event. Curve 21 denotes an upper limit beyond which the user's heart-rate should not extend, and curve 23 a lower limit.

For every exercise event (every time the user performs a physical activity of his own choice, the user will be required to keep his heart-rate as close as possible to the ideal curve 22, and not go outside the limits denoted by curves 21 and 23. If the user sticks to this heart-rate curve, it is believed that he will obtain the maximum benefits from the exercise regimen. If he goes outside the curve, he may be over-exercising or under-exercising, thus not obtaining the full benefits of exercise.

In all cases in the preferred embodiment the three sections, a, b and c, of the heart-rate curve will be straight. This simplifies the extrapolations necessary from actual heart-rate data, to create the curve. Only two items of data need to be established in order to enable creation of a heart-rate curve for any user. These are the user's resting heart-rate (RHR) and the user's preferred aerobic heart-rate (MHR). The RHR is the user's average heartbeat when he is at rest and not undergoing exercise. The MHR is the user's ideal heartbeat, calculated by the master data processor from the physiological parameters input thereto, for period b, the actual exercise period after "warm up" and before "cool down". These items of data together with the total exercise time calculated by the master data processor 101 enable extrapolation to produce the heart-rate curve. In the preferred embodiment, the warm up zones and cool down zones last only five minutes so the only variables are the actual exercise time, which will be calculated by the master data processor, RHR and MHR. The ideal heart-rate after the end of the cool down period can be calculated from a knowledge of the RHR and the MHR, to determine the slope of the cool-down curve in the cool-down period.

It is therefore not necessary for the master data processor 101 to store a heart-rate curve in analogue form, as such. Instead, it need only store the items of data discussed above, from which the heart-rate curve can be created by extrapolation. Printing means are provided for printing out a heart-rate curve for the user.

The upper limit curve 21 and the lower limit curve 23 may be extrapolated from "threshold" values calculated from the physiological data input to the master data processor. Only two threshold values are required to enable determination of the upper and lower curves. These threshold values are, respectively, an upper limit on the heartbeat and a lower limit on the heartbeat. In the preferred embodiment the threshhold values are calculated as a percentage of the aerobic heart-rate rounded to the nearest heart beat.

In a preferred embodiment, the user is not asked to perform his exercise to conform with the ideal heart-rate curve at first. Instead, a "build-up" period is allowed for the user, during which he will perform his exercise at lower rates than that specified by the heart-rate curve. In this way, the user can gradually build up to the heart-rate even in his ideal heart-rate curve. To facilitate this, the user will be provided with more than one heart rate curve. The heart-rate curves he will use for the build-up period will have either lower plateau levels or the plateau period will be shorter than is ultimately desirable possibly with longer warm up and cool down periods (i.e. the staging of changes from one section of the exercise programme to the next is altered) for the heart-rate than the ideal heart-rate curve. Where slower heart rate curves are employed the MHR for the lower heart-rate curves will be calculated from the MHR for the ideal heart-rate curve. For example, as a percentage of the ideal MHR.

The user will be expected to build up to the ideal heart-rate curve by performing exercise events to conform with the build-up curves for a specified "introductory" period. This has the advantage of allowing the user to become "habituated" to exercise gradually. The amount of build-up time required and the parameters of the build-up curves will depend on the physiological data input to the master data processing means.

In order to enable the user to monitor his progress and to determine whether or not he is following the heart-rate curve during exercise, the user is provided with a user monitor 102, which will now be discussed with reference to FIGS. 1 and 2 FIG. 3 and FIG. 4.

Referring to the figures, the user monitor includes a display 10 for displaying information to assist the user, and for providing an indication to the user as to whether his heart-rate is above or below predetermined limits, an audible alarm 36 for a similar purpose, and control keypad 11 (not shown in detail). The user monitor also includes audio pulse generating means 27, 28, 29 for transmitting data down a telephone line to the master data processor.

The user monitor 102 is arranged to be mounted relative to the user in a convenient position to enable the user to exercise and view the display 10 at the same time. It is preferably mounted on the user's wrist. It should be noted that the size of the monitor as shown in the drawing is not the actual size. It is smaller than illustrated and of a convenient size to be mounted on a user's wrist.

The user monitor is operable in conjunction with a heartbeat monitor 25 which will be mounted on the user's chest proximate the heart. The heart monitor 25 includes two electrodes 26 for monitoring heartbeat and signal processing and transmission means (not illustrated) for transmitting a signal indicative of heart-rate to the user monitor 102. Such heart monitors are known. The user monitor 102 includes a receiver 24 and signal processing means 35 for processing the received signal to provide an indication of heart-rate. The transmission between the heart monitor and the user monitor may be by radio or induction.

Alternatively, the heart monitor can be dispensed with and the user monitor connected via amplifier not shown) to chest contacts 26 for detecting the heart beat.

The user monitor also includes memory means 32 for storing data relating to the ideal heart-rate curve determined by the master data processor, i.e. RHR and MHR and exercise time. The processor means 35 also provides "reconstruction" of the ideal heart-rate curve from this stored data. Threshold data will also be stored in the user monitor to enable a determination of upper and lower limits for heart-rate during an exercise period.

RAM 33 is used to store data sampled during the performance of an exercise event.

In operation, during the performance of an exercise event, the processor means 35 of the user monitor makes an ongoing comparison during the time of the exercise event of the user's heart-rate with the heart-rate curve reconstructed from the heart-rate data input to the user monitor from the master data processor 101. A display 12 of the user's actual heart-rate is provided and display 11 of the required heart-rate in order for the user to follow the heart-rate curve at that particular time. Further visual and audio indicators are given for indicating whether the user is within the predetermined limits of the ideal heart-rate curve. These include threshold indicators 13, 18 and 19, which provide an indication whether the user's heartbeat is over or under the ideal heart-rate curve. Audible alarms are also given via a piezo element 36 to indicate whether the user's heartbeat is too high (high-pitched warning) or too low (low-pitched warning).

The processor means 35 of the user monitor is able to calculate, from the data stored therein, the heart-rate curve required as the exercise event is performed as well as threshold levels outside which the heart-rate of the user should not be extending at any particular time during the exercise event (as a percentage of the ideal MHR for example). More than one threshold value, both plus and minus ideal heart-rate curve, is given. For example, a "yellow" signal 18 on threshold indicators may indicate plus or minus six heartbeats from the ideal heart-rate curve, while a "red" indication 19 may indicate plus or minus 9 heartbeats. The alarm may sound at yet another threshold, if desired, for example the threshold value determined by curves 21 and 23 of FIG. 3.

The heart-rate curve can easily be extrapolated from knowledge of the resting heart-rate and MHR and exercise time, as for the master data processor. Similarly, threshold values at any time may also be calculated.

The user monitor includes a number of levels of access for the storage and alteration of data. One level of security access, not accessible by the user, will enable the initial storage of data relating to the heart-rate curve and the length of time for the exercise event. The user himself will generally not be able to alter this. This will only be able to be altered by the master data processor means or an operator associated with the master data processor means. The user will be able to access the watch by the control panel 11 to enable commencement and monitoring of an exercise event. This is by way of the second security access level. A further security access level may be provided to enable "reprogramming" of the user monitor.

The user will be able to adjust the exercise "level" by operating keypad 11. This enables the user to perform exercise at a lower level during an introductory period, as discussed above. Further, a facility is provided for extending the length of the plateau time if desired by the user. For example, the user may want to carry on exercising on the plateau b beyond the normal recommended time. This is permitted and the user will be able to exercise for an extra five minutes, for example, by actuation of an appropriate push button on the keypad 11.

The appropriate exercise level can be calculated by the processor 35 from knowledge of the MHR. Display 15 may also be arranged to provide an indication of which exercise level is being performed.

A timer display 15 is also provided which enables the user to monitor the time of exercise. This timer may be set to count three time intervals, being the warm-up period, the exercise period and the cool-down period.

A further display arranged to indicate the relative heart-rate is a display element 16 in the shape of a heart arranged to pulse on and off to indicate the user's heart-rate during exercise.

The user monitor contains a memory 33 arranged to store data relating to the performance of a user exercise event. The heart-rate of the user during an exercise event will be sampled at predetermined time periods by the user monitor and stored in the memory for subsequent downloading to the master data processing means 101 by way of the pulse code generator 29, 28, 27. The user monitor is also provided with an optical port or wired interface 30 which enables communication with a PC or master data processor means for programming or downloading of data. An advantage of an optical port is that it electrically isolates the user monitor from the device it is communicating with. The optical port also potentially enables the heart beat to be monitored by way of an infrared connection to a transmitter located approximate the heart. It may also enable output to a visual display unit, such as a television display, to enable a magnified display of heart rate, etc to be provided for the user.

The user monitor is also provided with a "log" function which may be operated by the user to accurately monitor his heart rate over a long period of time. The user wears the monitor 102 during the log function for an extended time period, say, 24 hours, during which the user monitor would be recording his heartbeat. This function could be used to give a very accurate value for the user's resting heart-rate, for example. The user monitor 102 calculates heart rate by measuring intervals between heartbeats and then calculates a running average of heart rate which is updated at approximately 0.5 second intervals. The monitor stores the current heart rate value every 3 seconds. However, memory constraints prevent the monitor from storing more than 3 hours of samples at 3 second intervals. 3 hours of samples would be ample for monitoring of normal exercise events, but when the device is in the logging mode it may be required to save samples for a period of 24 hours. To achieve this it starts out by saving samples every 3 seconds until the memory is full, at which time it starts saving samples at the rate of one every 6 seconds, deleting or overwriting every second one of the samples taken at 3 second intervals. Similarly, after 6 hours the monitor starts recording samples every 12 seconds and after 12 hours the monitor starts recording samples every 24 seconds etc. Each time the sampling interval doubles, half of the previously recorded samples will cease to be relevant, but using this technique, the client can be monitored over quite large periods of time. Samples recorded during logging mode can be uploaded to the master data processor 101 in the same way as samples recorded during an exercise event.

The user monitor thus provides a convenient means by which the user may monitor his heart-rate and performance during the carrying out of an exercise event. The back of the user monitor is provided with a covering of Velcro or the like 37. This enables the user monitor to be adhered to a wristband, to a surface of an exercise machine (for example an exercise bicycle, jogger, or step-up machine), or to any appropriate surface where the monitor can be conveniently viewed by the user.

The user will be expected to download data relating to his performance during his exercise regimen to the master data processor, by way of the pulse code output 27. All the user has to do is telephone the interactive voice response computer 105, hold the pulse code output 27 against the telephone and actuate an appropriate push button on the keyboard 4 in order to transfer data relating to an exercise event to the master data processor 101 which receives the data over a network from the interactive voice response computer 105. The user monitor 102 may store information for only one exercise event. This prompts the user to download the data to the master data processor means 101. He will not be able to use the user monitor 102 to perform a subsequent exercise event until he has done this. The user monitor 102 will appropriately "tag" information for a particular exercise event, so that it may be identified in time and also by user ID. Conveniently, each user monitor 102 will be provided with an ID known to the master data processor 101. The master data processor 101 will then be able to compare the data for each exercise event with the ideal heart-rate curve 22 and assess the user's performance.

At intervals the master data processor 101 will generate detailed reports relating to the user's performance which can be used to evaluate the user's progress. Aspects of the client's performance which will be specifically monitored will include:

1. How closely the user is maintaining his heart-rate to the heart-rate curve during exercise.
2. How frequently the user is performing exercise events.

The heart-rate curve is a useful tool for monitoring the user's progress. The user's performance in relation to the heart-rate curve provides useful information, which assists greatly in designing the ideal exercise regimen for the user: perhaps their heart-rate is rising too much during the warm-up zone of the heart print; perhaps the cool-down part of the heart-rate curve is too steep; perhaps the physical activity needs to be more steady in order to smooth out the heart-rate during the aerobic zone of the heart print; etc. This is in addition to the usefulness of the heart-rate curve as a tool for the user himself to ensure that he is doing the correct amount of exercise, and not doing too much or too little.

At frequent intervals, the client will also receive a printed report generated by the master data processor which will provide complete feedback on his exercise activity. This will show whether he stuck to his heart-rate curve during exercise, and how well he stuck to his heart rate curve. It will also show how frequently he exercised.

The user may also return to the exercise centre at intervals in order to have his physical profile retested and compare current results with earlier results. In this way the progress and development of the user and his exercise regimen is ensured.

The master data processor 101, as well as monitoring and comparing data from the user monitor 102, will also store the user information relating to his physiological profile, produce the heart-rate data curve which is ideal for the user, produce regular reports for the user, etc.

The master data processer 101 is arranged to allow access to user data by designated "personal trainers" (PTs). Each PT will be a qualified physical instructor responsible for the exercise progress of his designated users. To enable access to the system each PT will have his own special user monitor 106 adapted to identify the holder as a PT. Interaction between the PT and the master data processor 101 may be by telephone, the PT first identifying himself to the master data processor by pulse code transmission from the PT's user monitor 106 down telephone line. Alternatively, interaction between the PT and the data processor may be by means of a personal computer installed at the PT's home.

The master data processor 101 is arranged to monitor the performance of each user associated with a particular PT and to prepare a "report" for the PT at regular intervals, relating to the performance of the users in following their designated exercise regimens. The report may divide the users into a number of "performance categories". For example, one group may consist of users who have been exercising too hard, another group may consist of users who have not been exercising hard enough and yet another group may consist of users who have generally been performing their exercise regimen correctly.

The master data processor means 101 is preferably provided with means via interactive voice response computer 105 to enable "interactive voice recordings" (IVRs) to be made. This will enable the PT to place messages for each user in the master data processor 101. The voice message may be delivered when the user telephones the master data processor to download further exercise event data. Appropriate messages may include a "cool it" message if the user is exercising too hard, for example. When the PT receives his user report, he will be able to determine appropriate messages to put on the IVR. The user may also leave voice messages for the PT.

This capability gives the user the "feel" of human relationship even though the human interaction is much less than required of a personal trainer in a gymnasium.

The user monitor 102 may include other types of visual alarm than those illustrated. One visual alarm envisaged for another embodiment of the user monitor is in the form of the heart-shaped display 16 which indicates by the size of the heart displayed whether or not the user is within predetermined limits of his ideal heart-rate curve.

The user monitor 102 may also be held on a hinged platform attached to the chest of the user, in order to enable him to view the display without having to move his hands.

In the described embodiment, the heart rate curve has been used as a tool for monitoring the user's progress. It is possible that other physical parameters could be monitored than heart-rate. The present invention is not limited to a system which monitors the user's progress by monitoring heart rate.

It is convenient that the user monitor be provided with its own display. However, this is not strictly necessary. Other display means could be provided separate from the user monitor, e.g. a separate VDU.

The system of the present invention enables a single master data processor 101 to monitor the exercise regimens of a large number of users. Very little human interaction is necessary, merely requiring someone to maintain the master data processing means and provide support functions (mailing of reports, putting users through physiological tests, etc) and a number of personal trainers to provide human monitoring of a user's progress and human interaction with the system. It is envisaged that the master data processor 101 may also be able to automatically design appropriate exercise regimens, when appropriately programmed.

Referring to FIG. 5, the various interactions which occur in a system according to the present invention are illustrated. In summary, these interactions, indicated by interconnecting arrows, are as follows:

41. The client 107 is tested by the Personal Trainer (PT) at the Fitness Centre (FC) 104 on fitness assessment equipment 108 which may be MicroFit TM assessment equipment (MF), or, preferably, a range of other more conventional fitness assessment equipment. The fitness assessment equipment 108 which may measure various physiological indicators and which are then printed out together with an overall fitness percentage.
42. Using a range of other equipment the PT collects other physiological data.
43. The PT collects personal information from the client: name, address, phone, health history, profession; etc.
44. The PT, using the Fitness Centre Personal Computer 109 (FCPC), connects to the Fitness System Computer (FSC) 101 at the Fitness System Headquarters (FSH) 110 and manually enters the physiological and personal data.

NOTE: assume one FSH running 20 FC's 104 each controlling 1000 clients.

45. The FSC 101 displays the data on the FCPC 109. This shows the comparison to any earlier data for this client. The display may be printed if required. This data is known as the Client Profile Report (CPR).
46. The FSC then displays an exercise prescription. This display is copied to a local print format program on the FCPC 109, printed and given to the client.
47. Using the exercise prescription data the PT manually programs the heart Monitor (HM) or personal monitor 102 and instructs the client in its use.
48. If this is not the client's first visit the PT may request a profile history from the HSC 101 and print this locally from the HCPC 109.
50. Clients will exercise while wearing the HM 102.
51. At the conclusion of their exercise the clients will phone the Fitness System Interactive Voice Response Computer (FSIVR) 105 and down-load a string of DTMF data that the HM 102 has memorised during the exercise. This string will include the electronic serial number (ESN), this enables us to identify the client, the date and time of the exercise. It also includes a series of three digit numbers that present the HeartPrint (HP).
52. The FSIVR 105 would transfer the HP data to the FSC 101 via automatic interface.
53. The FSC 101 would generate daily activity data for use by the PT. This is an action list for the PT with the data needed to motivate the clients. Typically this highlights clients who are doing something wrong: not reporting when expected; warming-up too quickly; unsteady in the plateau phase; cooling down too fast.

54. The PT may access this list either through the FSIVR 105 or in hard copy.

55. The PT uses the FSIVR 105 to leave messages for those clients listed.

57. Those clients with messages would receive them at the time they next phone in with the HM data. The FSC 101 ensures that every client appears on a daily report at regular intervals even if this is only to congratulate the client for keeping to the program. In addition the PT may leave a message for the client to phone the PT for an actual, "real-time" conversation. The PT will also use the FSIVR 105 for various administrative communications: the client might need to come to the FC 104 for their regular test on the fitness assessment equipment 108 so that the PT can check their physiological progress; we may have a function coming up to which they are invited; etc. At the end of the message from the PT to the client, the FSIVR also gives the client an opportunity to leave a message in reply to the message left by the PT.

58. The FSC 101 will produce various reports for use by the FC staff. For example it will generate a one page Monthly Performance Report (MPR) summarising the client's HP's throughout the month and scoring the client's performance as a percentage. The FSH staff will mail or fax reports to the clients with copies to the PT and other third parties whom the client has authorised; doctors, employers, insurance companies, etc. Other administration reports will be generated by the FSC.

This system enables many users to be served by a single centre, without requiring frequent attendance at the centre or an expensive personal coach.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. An exercise monitoring system for monitoring the progress of a user in an exercise regimen, comprising master data processing means and a user monitor, the data processing means having storage means to store a preset physical parameter value relating to the user's exercise regimen and data receiving means to receive data transmitted by the user monitor, and the user monitor having exercise monitoring means to monitor a user's exercise event to measure a parameter value relating to the user exercise event, data storage means to store the measured parameter value and data transmitting means for transmitting the stored measured parameter value to the master data processing means after the exercise event is completed, the master data processing means further including data comparison means to compare the measured parameter value transmitted by the user monitor with the stored preset physical parameter value relating to the user's exercise regimen, and reporting means for reporting deviation of the transmitted parameter value from the stored physical parameter value whereby to monitor the user's progress in the exercise regimen.

2. The exercise monitoring system of claim 1 wherein the physical parameter measuring means is a heart-rate monitor including a transducer for monitoring a pulse of the user to produce a signal indicative of the pulse and signal processing means arranged to provide a signal indicative of an instantaneous heart rate of the user, which is stored as the measured parameter value.

3. The exercise monitoring system of claim 2 wherein each of a plurality of users is provided with a user monitor such that user exercise events of each of the plurality of users may be simultaneously monitored and the storage means of the master data processing means has a capacity to store a preset physical parameter for each of the plurality of users, the data receiving means is accessible by each of the user monitors to receive a transmitted measured parameter value from each user monitor and the data comparison means compares each transmitted measured parameter value with a respective one of the stored preset physical parameters.

4. The exercise monitoring system of claim 3 wherein the user monitor includes preset value storage means for storing values for the preset physical parameter corresponding to values stored in the master data processing means.

5. The exercise monitoring system of claim 4 wherein the user monitor includes indicating means in communication with the data comparison means to indicate when a measured physical parameter measured during the user's exercise event is above or below the preset value stored in the preset value storage means to assist the user in maintaining the physical parameter as close as possible to the stored values in the master data processing means.

6. The system of claim 5 wherein the transmission means sequentially transmits to the master data processing means, all of the plurality of values of the measured physical parameters stored in the user monitor for comparison with the preset values stored in the master data processing means.

7. The exercise monitoring system of claim 5 wherein the heart rate data stored in the preset value storage means defines a heart-rate profile, against time, during the period of a single exercise event, and the indicating means includes comparison means for comparing the heart-rate of the user during the exercise event with the stored heart-rate profile, to determine whether or not the user's heart-rate is within predetermined limits of the heart-rate profile.

8. The exercise monitoring system of claim 7 wherein the heart-rate data stored in the preset value storage means is stored as a series of heart-rate values for predetermined time intervals during the exercise event.

9. The exercise monitoring system of claim 5 wherein the user monitor includes time stamp storage means for storing data indicating a date and time of an exercise event, the date and time data being transmitted to the master data processing means with the physical parameter data for the particular exercise event, to enable the master data processing means to establish the time at which the exercise event occurred.

10. The exercise monitoring system of claim 5 wherein the user monitor includes identification means programmed with identification data which enables identification of the user monitor by the master data processing means, this identification data being transmitted to the master data processing means with the physical parameter data.

11. The system of claim 2 wherein the user monitor includes event memory means for storing a plurality of values of the measured physical parameter measured at predetermined intervals during the performance of the exercise event by the user and the storage means of the master data processing means has a capacity to store the plurality of values for the measured physical parameter measured at the predetermined intervals over a period of time corresponding to the length of time of the user's exercise event.

12. The exercise monitor system of claim 2 wherein the master data processor includes an interactive voice recording means on which a personal trainer associated with a respective one of the users may make a voice recording, the voice recording being accessible by the respective user to receive feedback from his trainer.

13. The exercise monitoring system of claim 2 wherein the master data processing means is arranged to operate in an unattended manner, and the data receiving means includes an auto-answer means to automatically establish communication with a user monitor in response to a transmission initiated by the user monitor and to thereby receive data from the user monitor.

14. The exercise monitoring system of claim 13 wherein the user monitor includes an interfacing means for connection to a standard telephone handset to send information down a telephone line and the data receiving means of the mater data processing means is an auto answer modem.

15. An exercise monitor for facilitating monitoring of the progress of a user in an exercise regime, the exercise monitor including exercise monitoring means to monitor a user exercise event physical parameter measuring means to measure physical parameter data during an exercise event, storage means to store the measured parameter values and data transmitting means for transmitting the stored measured physical parameter data to a central monitoring system after the exercise event is completed.

16. The exercise monitor of claim 15 wherein the physical parameter measuring means is a heart-rate monitor including a transducer for monitoring a pulse of the user to produce a signal indicative of the pulse and signal processing means arranged to provide a signal indicative of an instantaneous heart rate of the user, which is stored as the measured parameter value.

17. The exercise monitor of claim 16 wherein the central monitoring system includes storage means for storing preset values for the physical parameter defining a heart rate profile, against time, for the period of a single exercise event.

18. The exercise monitor of claim 17 wherein the user monitor includes preset value storage means arranged to store preset values for the physical parameter corresponding to values stored in the storage means of the central monitoring system.

19. The exercise monitor of claim 18 wherein the heart-rate is stored as a plurality of heart-rate readings for predetermined time intervals during the exercise event.

20. The exercise monitor of claim 19 wherein the monitor includes event memory means for storing a plurality of values of the physical parameter measured during the performance of the exercise event by the user for later transmission to the central monitoring system by the transmission means.

21. The exercise monitor of claim 20 wherein the storage means of the user monitor is programmed with data which enables identification of the user monitor by the central monitoring system, and this identification data is transmitted to the central monitoring system and the physical parameter data and including logging mode initiating means.

22. The exercise monitor of claim 21 wherein the monitor stores data indicting date and time of an exercise event, the date and time data being transmitted with the physical parameter data for the particular exercise event, to enable the central monitoring system to establish the time at which the exercise event occurred.

23. The exercise monitor of claim 16, the monitor including data comparison means to compare the measured parameter value with a preset value for a point in the profile corresponding to a current position in the exercise event, indicating means in communication with the comparison means to indicate when a physical parameter value measured during the user's exercise event is above or below the corresponding parameter value stored in the present value storage means to assist the user in maintaining the physical parameter as close as possible to an expected parameter profile.

24. The exercise monitor of claim 23 wherein the preset value storage means is arranged to store heart-rate data in a form defining a heart-rate profile, against time, during the period of a single exercise event, and the indicating means includes comparison means for comparing the heart-rate of the user during the exercise event with the stored heart-rate profile, to determine whether or not the user's heart-rate is within predetermined limits of the heart-rate profile.

25. The exercise monitor of claim 23 wherein the transmission means is arranged to transmit all of the plurality of stored values of the measured physical parameter stored during a single exercise event to the central monitoring system.

26. The exercise monitor of claim 15 including logging mode initiating means and wherein the control means is responsive to the logging mode initiating means for measuring the physical parameter over an extended period of time and to store sample values of the measured parameter in the storage means at regular sample time intervals.

27. The exercise monitor of claim 26 wherein the control means monitors the storage means and when the storage means is full the control means increases the sample interval and discards previously stored samples which do not correspond to the increased sample interval to provide storage space for further samples.

28. The exercise monitor of claim 27 wherein the sample interval is initially set at a value of 3 seconds and when the interval is increased, its increased value is two times the previous value of the sample interval.

29. A method of monitoring the progress of a user in an exercise regimen, comprising the steps of storing a preset physical parameter target value relating to the user's exercise regimen in a master data processing means, monitoring a user exercise event by measuring and storing the physical parameter value using a user monitoring device, transmitting the stored measured parameter value relating to the exercise event from the user monitoring device to the master data processor means after the exercise event is completed, and using the master data processing means to compare the transmitted parameter value with the stored preset physical parameter value relating to the user's exercise regimen to determine the user's performance from the results of the comparison step and reporting the user's performance relative to his preset value.

30. The method of monitoring of claim 29 wherein the step of measuring the physical parameter includes the steps of measuring the user's pulse and determining the user's heart-rate from the pulse measurements and in the transmission step the measured parameter transmitted to the master data processor is the user's heart-rate.

31. The method of monitoring of claim 30 wherein the step of monitoring the exercise events of a user is repeated for a plurality of users using a plurality of user monitoring devices and the steps of transmitting a measured physical parameter to the master data processing means and storing the measured parameter in the storage means of the master data processing means are performed for each of the plurality of users, each user independently transmitting the measured physical parameter value measured by the respective user monitoring device to the master data processing means and a comparison of transmitted and stored parameters being performed for each user to produce a respective performance report for that user.

32. The method of monitoring of claim 31 including indicating when any physical parameter measured during the user's exercise event is above or below the corresponding preset parameter value stored in the master data processing means to assist the user in maintaining the physical parameter as close as possible to the expected parameter profile.

33. The method of monitoring of claim 30 wherein the preset value storage step of the master data processor stores a plurality of values for the physical parameter in the master data processing means corresponding to an expected parameter profile over a period of time presenting the length of time of the user's exercise event.

34. The method of monitoring of claim 33 including storing preset values for the physical parameter in the user monitoring device, corresponding to values stored in the master data processing means.

35. The method of monitoring of claim 34 including storing the physical parameters measured during the performance of a single exercise event by the user in an event memory in the user monitoring device.

36. The method of monitoring claim 35 including downloading all of the stored values of the physical parameters measured during the exercise event to the master data processing means and comparing the measured parameters with the preset values stored therein after the exercise event is completed.

37. The method of monitoring of claim 35 wherein the step of storing the preset data in the user monitoring device includes storing heart-rate data in a form defining a heart-rate profile, against time, during the period of a single exercise event, and the step of comparing each measured physical parameter with the corresponding stored preset value is performed by comparing the heart-rate of the user during the exercise event with the stored heart-rate profile, and the indicating step indicates whether or not the user's heart-rate is within predetermined limits of the heart-rate profile.

38. The method of monitoring of claim 37 wherein the step of storing the measured heart-rate data includes storing a plurality of heart-rate readings for predetermined time intervals during the exercise event.

39. The method of monitoring of claim 38 wherein the step of storing the measured heart rate data includes a step of determining and storing data indicative of a date and time of an exercise event in the user monitoring device and the transmitting step includes transmitting the date and time data together with the measured physical parameter data for the particular exercise event, to enable the master data processor to establish the time of the exercise event.

40. The method of monitoring of claim 37 including storing identification data in the monitoring device which enables identification of the user by the master data processing means and the transmission step includes transmitting the identification data with the measured physical parameter data.

41. The method of monitoring of claim 29 including a review step wherein a personal trainer associated with a respective one of the users examines the report produced on the user and makes a voice recording of feedback information on an interactive voice recording means and a feedback step in which the respective user accesses the voice recording to receive feedback information from his trainer.

42. The method of monitoring of claim 29 including operating the master data processing means in an unattended manner, a data receiving means associated with the master data processing means for automatically establishing communication with a user monitoring device in response to a transmission initiated by the user monitoring device, and receiving data transmitted from the user monitoring device and passing the data to the master data processing means.

43. The method of monitoring of claim 42 wherein the transmitting step includes communications with the master data processing means via dial-up telephone connection.

44. The method of monitoring of claim 43 wherein the transmitting step includes connecting the user monitoring device to a standard telephone handset via an acoustic interfacing means, dialing up a connection with the master data processor by using a dialing mechanism of the handset and then transmitting a data modulated signal down a telephone line via the handset, receiving the transmitted data at the receiving means via an auto answer modem with which the data modulated signal is compatible.

* * * * *